US007810892B2

(12) United States Patent
Yamaguchi et al.

(10) Patent No.: US 7,810,892 B2
(45) Date of Patent: Oct. 12, 2010

(54) ELEMENT SUBSTRATE, PRINTHEAD, HEAD CARTRIDGE, AND PRINTING APPARATUS

(75) Inventors: Takaaki Yamaguchi, Yokohama (JP); Yoshiyuki Imanaka, Kawasaki (JP); Koichi Omata, Kawasaki (JP); Souta Takeuchi, Yokohama (JP); Kousuke Kubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 497 days.

(21) Appl. No.: 11/874,985

(22) Filed: Oct. 19, 2007

(65) Prior Publication Data

US 2008/0111864 A1 May 15, 2008

(30) Foreign Application Priority Data

Nov. 13, 2006 (JP) ..... 2006-307222

(51) Int. Cl.
*B41J 29/38* (2006.01)

(52) U.S. Cl. ..... 347/5; 347/9; 347/13

(58) Field of Classification Search ..... 347/5, 347/9, 12, 13, 42, 43
See application file for complete search history.

(56) References Cited

U.S. PATENT DOCUMENTS

| | | | | |
|---|---|---|---|---|
| 6,102,510 | A * | 8/2000 | Kikuta et al. | 347/9 |
| 6,243,111 | B1 * | 6/2001 | Imanaka et al. | 347/13 |
| 6,280,012 | B1 | 8/2001 | Schloeman et al. | |
| 6,742,874 | B2 | 6/2004 | Hirayama et al. | |
| 7,581,797 | B2 * | 9/2009 | Kasai | 347/5 |
| 2004/0021739 | A1 | 2/2004 | Fujii et al. | |
| 2004/0109036 | A1 | 6/2004 | Han | |
| 2007/0139480 | A1 | 6/2007 | Yamaguchi et al. | |
| 2008/0100649 | A1 | 5/2008 | Matsui et al. | |
| 2008/0129782 | A1 | 6/2008 | Kubo et al. | |

FOREIGN PATENT DOCUMENTS

| | | |
|---|---|---|
| EP | 1 016 524 A2 | 7/2000 |
| EP | 1 029 674 A2 | 8/2000 |
| JP | 7-068761 | 3/1995 |
| JP | 2004-050846 | 2/2004 |

* cited by examiner

*Primary Examiner*—Lam S Nguyen
(74) *Attorney, Agent, or Firm*—Fitzpatrick, Cella, Harper & Scinto

(57) ABSTRACT

An element substrate includes a plurality of printing elements, a plurality of driving circuits which drive the plurality of printing elements, an input unit which inputs an enable signal to define the driving period of each printing element, a shift register which inputs a print data, a latch circuit which stores, in accordance with an externally input latch signal, the print data output from the shift register and outputs a print data signal, a time-divisional selection circuit which generates a block selection signal to divide the plurality of printing elements into a plurality of blocks and time-divisionally drive the printing elements, and a delay unit which changes the drive timing between the printing elements in a single block. The delay unit delays the enable signal and the print data signal.

13 Claims, 15 Drawing Sheets

ELEMENT SUBSTRATE, PRINTHEAD, HEAD CARTRIDGE, AND PRINTING APPARATUS

BACKGROUND OF THE INVENTION

1. Field of the Invention

The present invention relates to an inkjet printhead element substrate which comprises a printing element, a shift register, a latch circuit and a delay circuit which delays an input signal and outputs the signal, and a printhead, head cartridge, and printing apparatus using the element substrate.

2. Description of the Related Art

In a recent printhead used for an inkjet printing method (liquid-jet printing method), thermal energy generated by heaters serving as printing elements is applied to a liquid to cause it to bubble. The energy for generating a bubble causes orifices to discharge ink droplets. Such a printhead has a number of very small heaters arranged on a silicon semiconductor substrate to enable high-density printing. Additionally, orifices are arranged to oppose each of the heaters. Driving circuits for driving the heaters and other logic circuits are also provided on the silicon semiconductor substrate. For example, several tens to several thousands of heaters, drivers for driving the respective heaters, a shift register having bits as many as the heaters, and a latch circuit for temporarily storing print data (print signal) output from the shift register are provided on a single silicon semiconductor substrate. Note that the shift register finally sends the serially input print data to the drivers in parallel.

That is, integration of drivers and logic circuits such as a shift register and latch circuit on an element substrate has progressed recently. In this case, a current that flows to one heater instantaneously reaches a considerably large value. If a lot of heaters are turned on simultaneously, a pulse-like current of, for example, about 1 to several A flows to the power supply line and ground (GND) line for driving the heaters.

When a current flows, induction noise is generated by inductive coupling in flexible wirings from the printing apparatus main body to the printhead or wiring in the printhead. If a pulse-like current having a large value flows, as described above, operation errors may occur in the logic circuit parts on the printhead element substrate. Unwanted electromagnetic noise may be radiated externally.

Induction noise more readily occurs, and its noise level rises as the current change amount per unit time increases. More specifically, when the number of orifices provided in the printhead increases, and the number of elements turned on simultaneously increases for high-speed or high-resolution printing, the value of the pulse-like current also becomes large, resulting in higher noise level.

To prevent this, the orifices are divided into a plurality of blocks, and the blocks are time-divisionally driven, instead of simultaneously driving many heaters provided on the printhead element substrate. More specifically, at a given timing, the first block is selected to drive the heaters while inhibiting driving of the heaters in the remaining unselected blocks. At the next timing, the heaters in the second block are selectively driven while inhibiting driving of the heaters in the remaining blocks. All blocks are selected in this way one after another, thereby completing one cycle of driving of the heaters corresponding to all orifices.

However, if many orifices exist (if many heaters exist), the number of orifices per block also increases. For this reason, the current value does not sufficiently decrease so it is impossible to suppress the amount of induction noise generation. If the number of blocks is increased to reduce the number of heaters to be turned on simultaneously, the time allotted to every block shortens. Hence, it may be unable to obtain sufficient energy for ink discharge. To obtain desired energy, the time allotted to every block is made long. However, this reduces the printing speed.

There is disclosed an arrangement which shifts, little by little, the driving pulse to be applied to heaters belonging to a single block (Japanese Patent Publication Laid-Open No. 07-68761). More specifically, in forming an element substrate for an inkjet printhead, a hysteresis circuit is provided in an input unit together with the elements of heaters, drivers, and logic discharge control circuits such as a shift register. To apply driving pulses to different heaters at different timings, a CR (capacitor-resistor) integrating circuit is formed in the signal path of a heat pulse signal (input pulse width signal) that defines the pulse width and timing of a driving pulse. The heat pulse signal is delayed to sequentially drive the heaters. That is, the current flowing to the heaters is controlled by shifting the timing of the heat pulse signal using the CR integrating circuit. This reduces the number of heaters to be turned on at the same timing and decreases the peak value and rise ratio of the current generated by the driving pulse, thereby suppressing noise. Even when the number of heaters to be driven simultaneously increases due to an increase in the number of orifices or high-density arrangement of orifices necessary for high-speed printing, induction noise generation is suppressed.

However, even in the arrangement that prevents noise by using the CR integrating circuit, as disclosed in Japanese Patent Laid-Open No. 07-68761, if C (capacitor) and R (resistor) vary, the product of them generates a variation in the delay value of the heat pulse signal. It is therefore impossible to accurately control the current flowing to the heaters. It may consequently be unable to sufficiently suppress noise. The CR integrating circuit includes an input buffer, capacitor, and resistor. If the wiring length difference between these logic circuits becomes large, the delay value varies. In an inkjet printhead element substrate which is manufactured by using a typical silicon semiconductor device manufacturing technology, often, a capacitor uses a gate oxide film, and a resistor uses a diffused resistor. For this reason, if a CR integrating circuit having a desired time constant is formed, the capacitor and resistor occupy a large area of the element substrate for an inkjet printhead, resulting in a bulky inkjet printhead element substrate.

There is proposed an arrangement which forms, on an input line to input a pulse width defining signal, a CMOS inverter circuit serving as a logic circuit for applying a driving pulse to heaters at different timings (Japanese Patent Laid-Open No. 2004-50846).

On the other hand, the recent inkjet printhead element substrate is positively introducing high-density integration of heaters and an increase in the number of nozzles in order to improve the printing speed and image quality.

As described above, high-density integration of heaters and an increase in the number of nozzles are positively introduced recently. The high-density integration of heaters can be achieved by reducing the ink droplet size and arranging nozzles at a high density. However, to maintain the same printing speed, the driving frequency needs to be higher than before along with the increase in the integration density. In addition, to obtain a higher printing speed than before, the driving frequency needs to be further higher.

When the driving frequency rises, the driving period shortens naturally. In this case, when the heat pulse signal is delayed by using a delay circuit in correspondence with the number of heaters in a block from the viewpoint of noise reduction, as described above, the heat pulse signal may exceed the span of the latch signal period from a latch signal to the next latch signal depending on the delay amount. If the heat pulse signal exceeds the span of the latch signal period, when the heat pulse signal is being input to the heaters in a given block, the logic may switch to drive different heaters halfway so the desired heaters cannot be driven. Hence, there is a demand for development of an element substrate capable of stably driving desired heaters even when the driving frequency rises.

The above-described problem arises not only when the driving frequency rises but also when the number of heaters to be driven in a single block increases.

The technique disclosed in Japanese Patent Laid-Open No. 2004-50846 can surely suppress noise and prevent an increase in the size of an inkjet printhead element substrate. However, it cannot solve the problem that driving of desired heaters is hindered at a higher driving frequency.

SUMMARY OF THE INVENTION

The present invention is directed to an element substrate, printhead, head cartridge, and printing apparatus.

It is possible to provide an element substrate which solves the problem that driving of desired heaters is hindered when the driving frequency rises, or the number of heaters to be driven in a single block increases. It is also possible to provide a printhead, head cartridge, and printing apparatus using the element substrate.

According to one aspect of the present invention, there is provided a printhead element substrate including a plurality of printing elements, a plurality of driving circuits which drive the plurality of printing elements, input means for inputting an enable signal to define a driving period of each printing element, a shift register which inputs a print data, a latch circuit which stores, in accordance with an externally input latch signal, the print data output from the shift register and outputs a print data signal, and a time-divisional selection circuit which generates a block selection signal to divide the plurality of printing elements into a plurality of blocks and time-divisionally drive the printing elements, comprising:

delay means for changing a drive timing between printing elements in a single block, the delay means delaying the enable signal and the print data signal.

According to another aspect of the present invention, preferably, there is provided a printhead which has an element substrate including a plurality of printing elements, a plurality of driving circuits which drive the plurality of printing elements, input means for inputting an enable signal to define a driving period of each printing element, a shift register which inputs a print data, a latch circuit which stores, in accordance with an externally input latch signal, the print data output from the shift register and outputs a print data signal, and a time-divisional selection circuit which generates a block selection signal to divide the plurality of printing elements into a plurality of blocks and time-divisionally drive the printing elements, the element substrate comprises:

delay means for changing a drive timing between printing elements in a single block, the delay means delaying the enable signal and the print data signal.

According to still another aspect of the present invention, preferably, there is provided a head cartridge which has a printhead including an element substrate including a plurality of printing elements, a plurality of driving circuits which drive the plurality of printing elements, input means for inputting an enable signal to define a driving period of each printing element, a shift register which inputs a print data, a latch circuit which stores, in accordance with an externally input latch signal, the print data output from the shift register and outputs a print data signal, and a time-divisional selection circuit which generates a block selection signal to divide the plurality of printing elements into a plurality of blocks and time-divisionally drive the printing elements, and an ink tank which contains ink, the element substrate comprises:

delay means for changing a drive timing between printing elements in a single block, the delay means delaying the enable signal and the print data signal.

According to still another aspect of the present invention, preferably, there is provided a printing apparatus which has a printhead including an element substrate including a plurality of printing elements, a plurality of driving circuits which drive the plurality of printing elements, input means for inputting an enable signal to define a driving period of each printing element, a shift register which inputs a print data, a latch circuit which stores, in accordance with an externally input latch signal, the print data output from the shift register and outputs a print data signal, and a time-divisional selection circuit which generates a block selection signal to divide the plurality of printing elements into a plurality of blocks and time-divisionally drive the printing elements, the element substrate comprises:

delay means for changing a drive timing between printing elements in a single block, the delay means delaying the enable signal and the print data signal.

The invention is particularly advantageous since it is possible to provide an element substrate which can avoid any influence of driving period switching even in an arrangement that inputs delayed heat pulse signals to a plurality of heaters in a single block from the viewpoint of noise reduction.

Further features of the present invention will become apparent from the following description of exemplary embodiments (with reference to the attached drawings).

DESCRIPTION OF THE EMBODIMENTS

The embodiments of the present invention will be described next with reference to the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "link" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

An "element substrate" in the description indicates not a simple substrate made of a silicon semiconductor but a substrate with elements and wirings.

The expression "on an element substrate" indicates not only "on the surface of an element substrate" but also "inside of an element substrate near its surface". The term "built-in" in the present invention indicates not "simply arrange separate elements on a substrate" but "integrally form elements on an element substrate in a semiconductor circuit manufacturing process".

[Inkjet Printing Apparatus]

Figure 9:
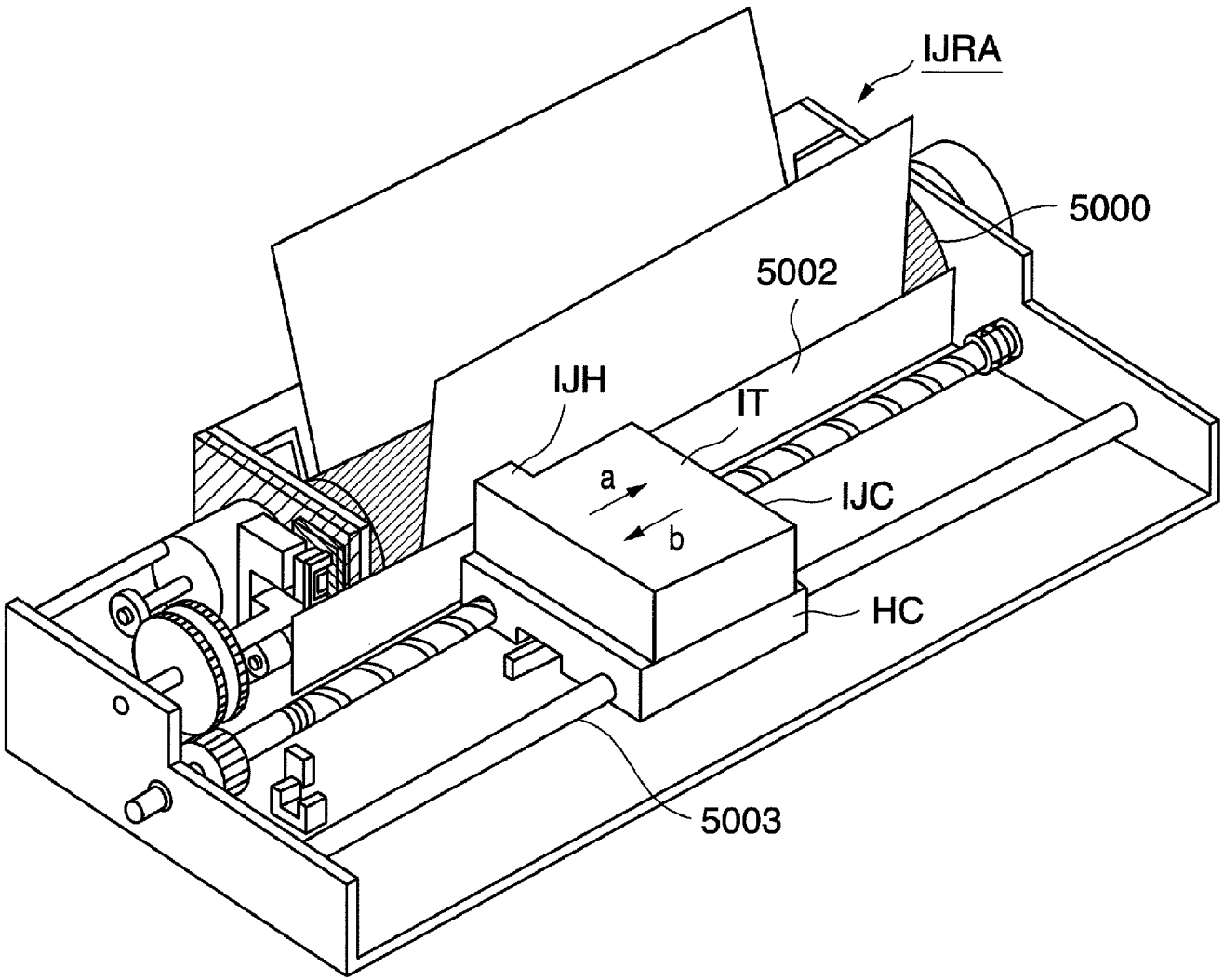
FIG. 9 is a perspective view showing the schematic arrangement of a general inkjet printing apparatus.

FIG. 9 is an external perspective view showing the schematic arrangement of an inkjet printing apparatus IJRA according to a typical embodiment of the present invention.

Referring to FIG. 9, a carriage HC has a pin (not shown) and reciprocally moves in the directions of arrows a and b while being supported by a guide rail 5003. An integrated inkjet cartridge IJC incorporating a printhead IJH and an ink tank IT is mounted on the carriage HC. A paper press plate 5002 presses a print medium P against a platen 5000 in the moving direction of the carriage HC.

A control arrangement for executing print control of the above-described apparatus will be described next.

Figure 10:
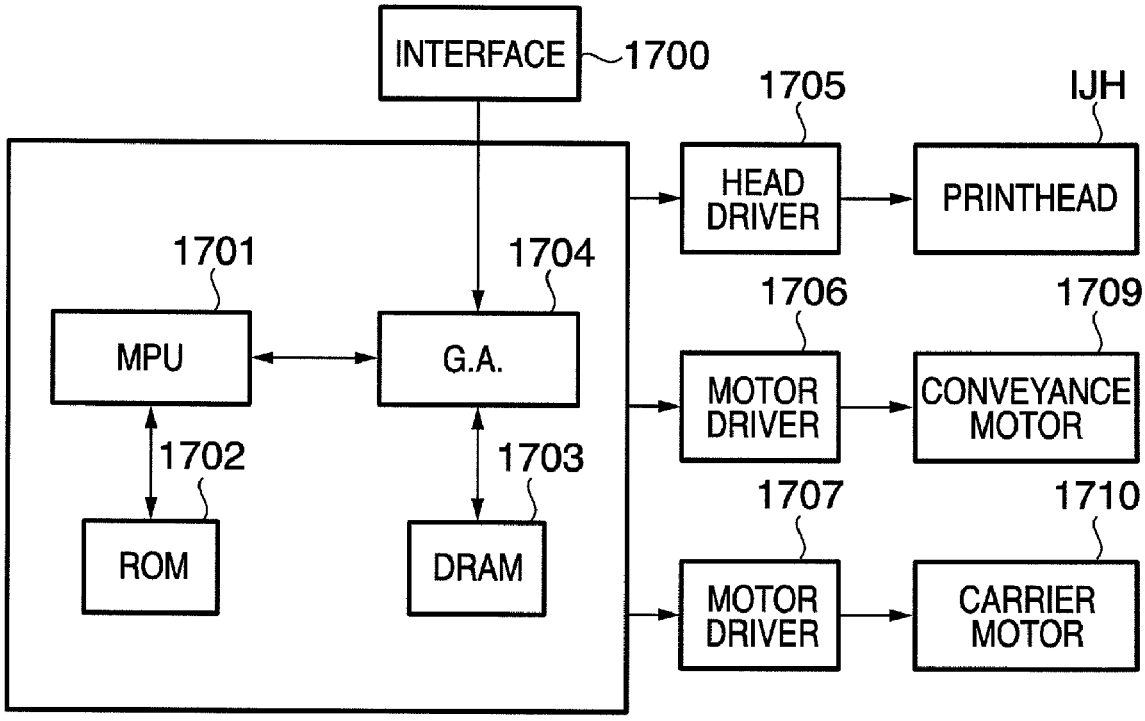
FIG. 10 is a block diagram showing the control arrangement of a general inkjet printing apparatus.

FIG. 10 is a block diagram showing the arrangement of the control circuit of the inkjet printing apparatus IJRA.

Referring to FIG. 10, reference numeral 1700 denotes an interface that inputs a print signal; 1701, an MPU; 1702, a ROM that stores a control program to be executed by the MPU 1701; and 1703, a DRAM that saves various kinds of data (e.g., the print signal and print data to be supplied to the printhead IJH). A gate array (G.A.) 1704 controls print data supply to the printhead IJH and data transfer between the interface 1700, MPU 1701, and RAM 1703. A carrier motor 1710 conveys the printhead. A conveyance motor 1709 conveys a print medium. A head driver 1705 drives the printhead IJH. A motor driver 1706 drives the conveyance motor 1709. A motor driver 1707 drives the carrier motor 1710.

The operation of the control arrangement will be described. When a print signal is input to the interface 1700, the print signal is converted into print data for printing between the gate array 1704 and the MPU 1701. The motor drivers 1706 and 1707 are driven. In addition, the printhead IJH is driven in accordance with the print data sent to the head driver 1705 so that printing is executed.

Various kinds of signals (to be described later) are supplied to the printhead through the head driver.

[Printhead]

The inkjet printhead will be described next.

Figure 3B:
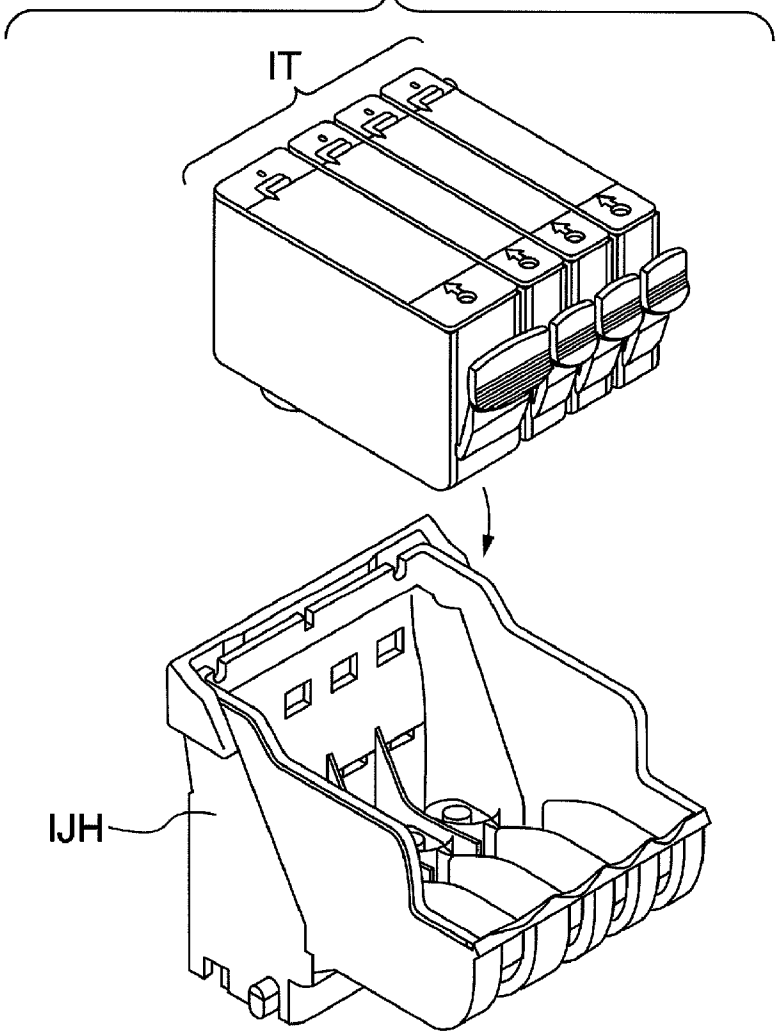
FIGS. 3A and 3B are perspective views of a general inkjet printhead.
Figure 3A:
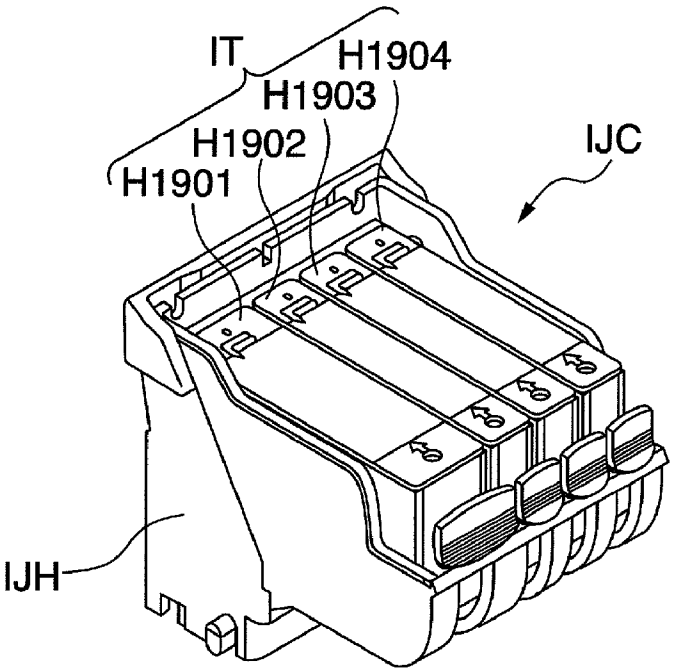

The printhead IJH of this embodiment is an element of the head cartridge IJC, as is apparent from the perspective views in FIGS. 3A and 3B. The head cartridge IJC includes the printhead IJR and the ink tank IT (H1901, H1902, H1903, and H1904) detachably provided on the printhead IJH. The ink tank IT supplies ink (print liquids) to the printhead IJH, and the printhead IJH discharges the ink from the discharge orifices in accordance with print information.

The positioning unit and electrical contacts of the carriage HC incorporated in the inkjet printing apparatus IJRA stationarily support the head cartridge IJC. The head cartridge IJC is detachable from the carriage HC.

Figure 4:
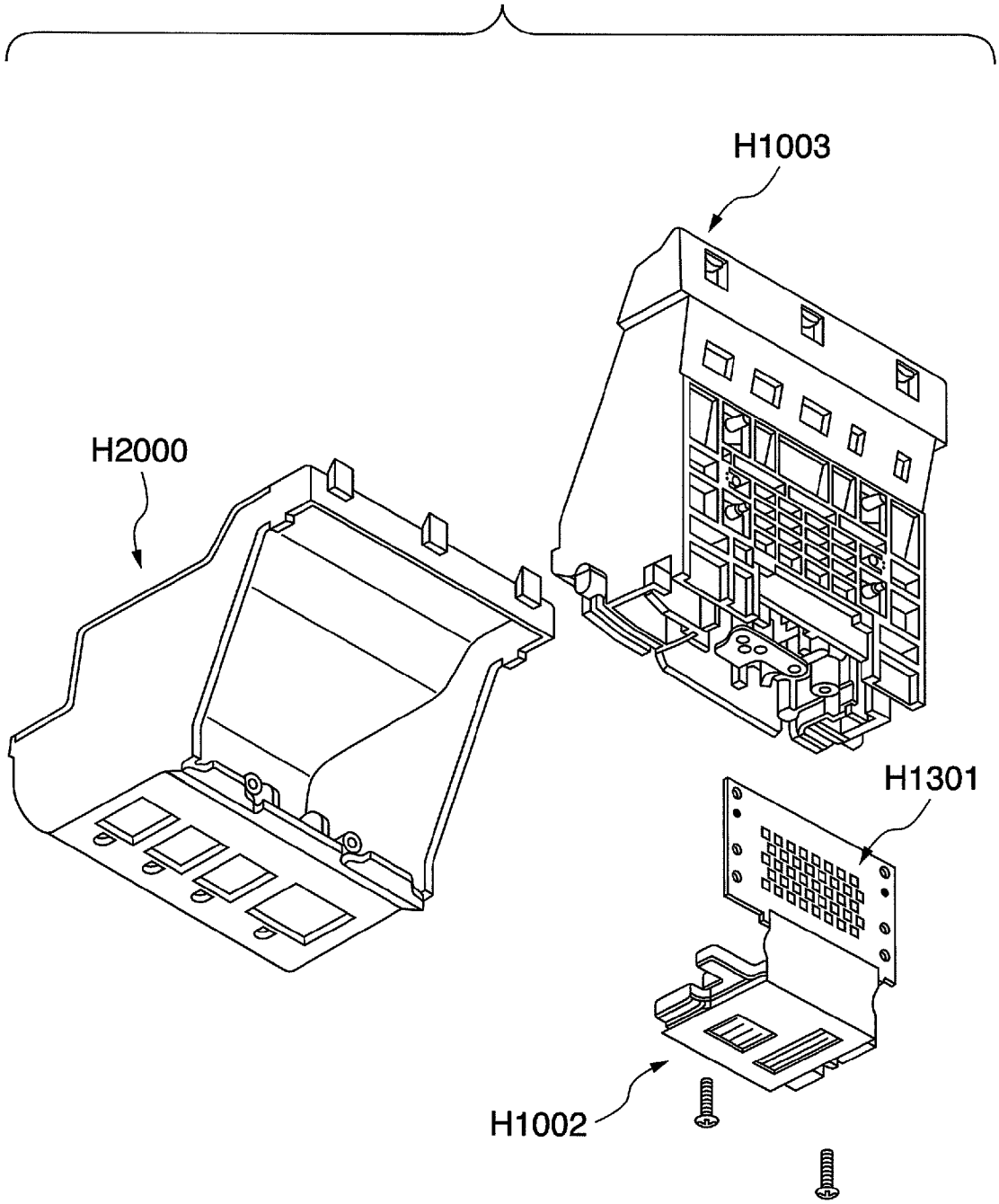
FIG. 4 is an exploded perspective view of a general inkjet printhead.

The printhead IJH includes a printhead unit H1002, ink supply unit (print liquid supply unit) H1003, and tank holder H2000, as shown in the exploded perspective view of FIG. 4.

Figure 5:
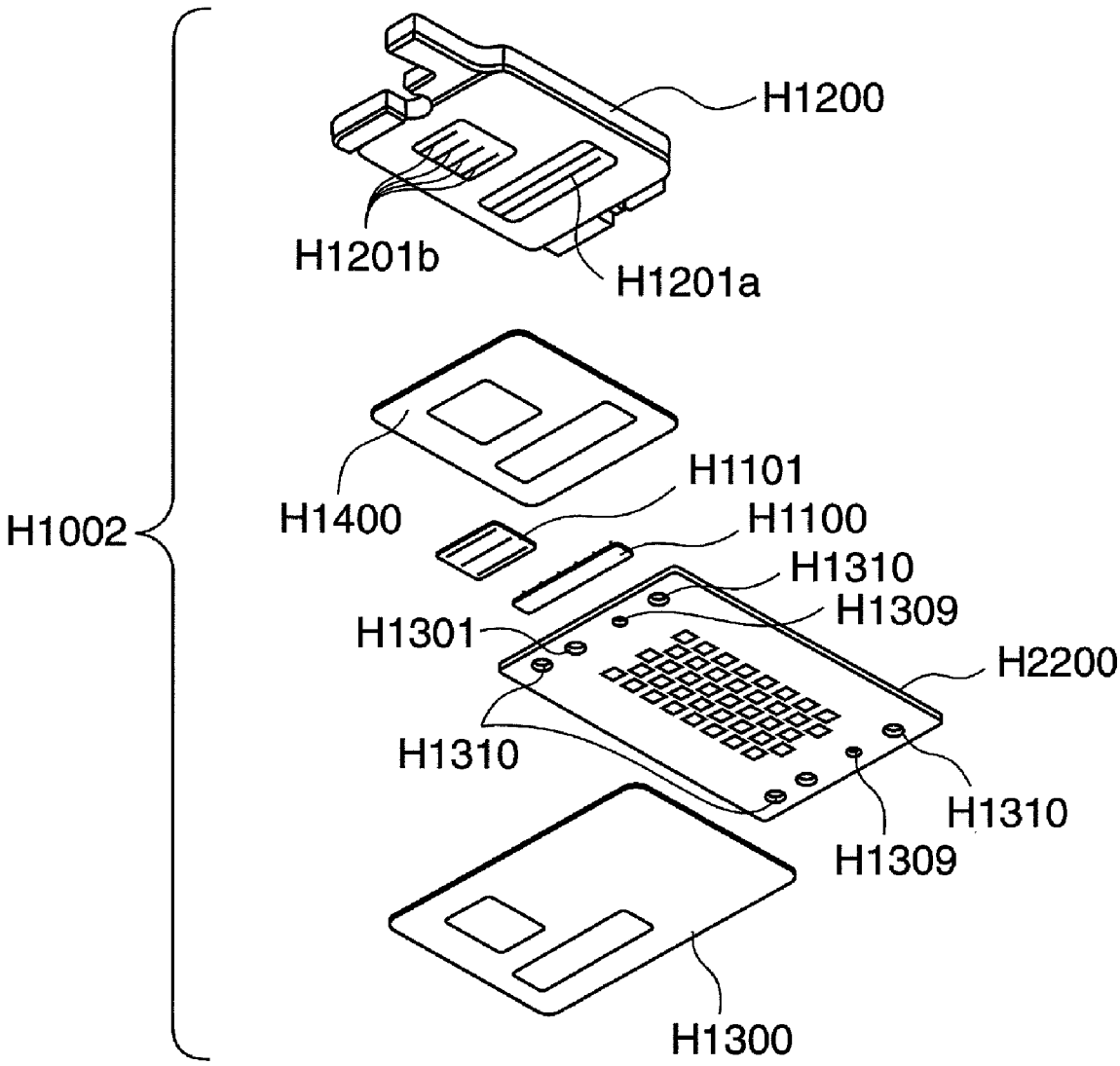
FIG. 5 is an exploded perspective view of a general inkjet printhead.

A first element substrate H1100 is an element substrate to discharge black ink which is bonded and fixed on a first plate H1200, as shown in the exploded perspective view of FIG. 5. A second plate H1400 having opening portions is bonded and fixed on the first plate H1200. An electric wiring tape H1300 is bonded and fixed on the second plate H1400 by the TAB method so as to hold the positional relationship with respect to the first element substrate H1100. The electric wiring tape H1300 includes an electric wiring corresponding to the first element substrate H1100 and applies an electrical signal for ink discharge to the first element substrate H1100. The electric wiring tape H1300 is connected to an electric contact substrate H2200 having external signal input terminals H1301 to receive the electrical signal from the inkjet printing apparatus main body. The electric contact substrate H2200 is located and fixed on the ink supply unit H1003 by terminal locating holes H1309 (at two points) A second element substrate H1101 is an element substrate to discharge three color inks. The first plate H1200 has an ink communicating port H1201*a* to supply black ink to the first element substrate H1100. The first plate H1200 also has ink communicating ports H1201*b* to supply color inks of cyan, magenta, and yellow to the second element substrate H1101.

[Head Cartridge]

Figure 11:
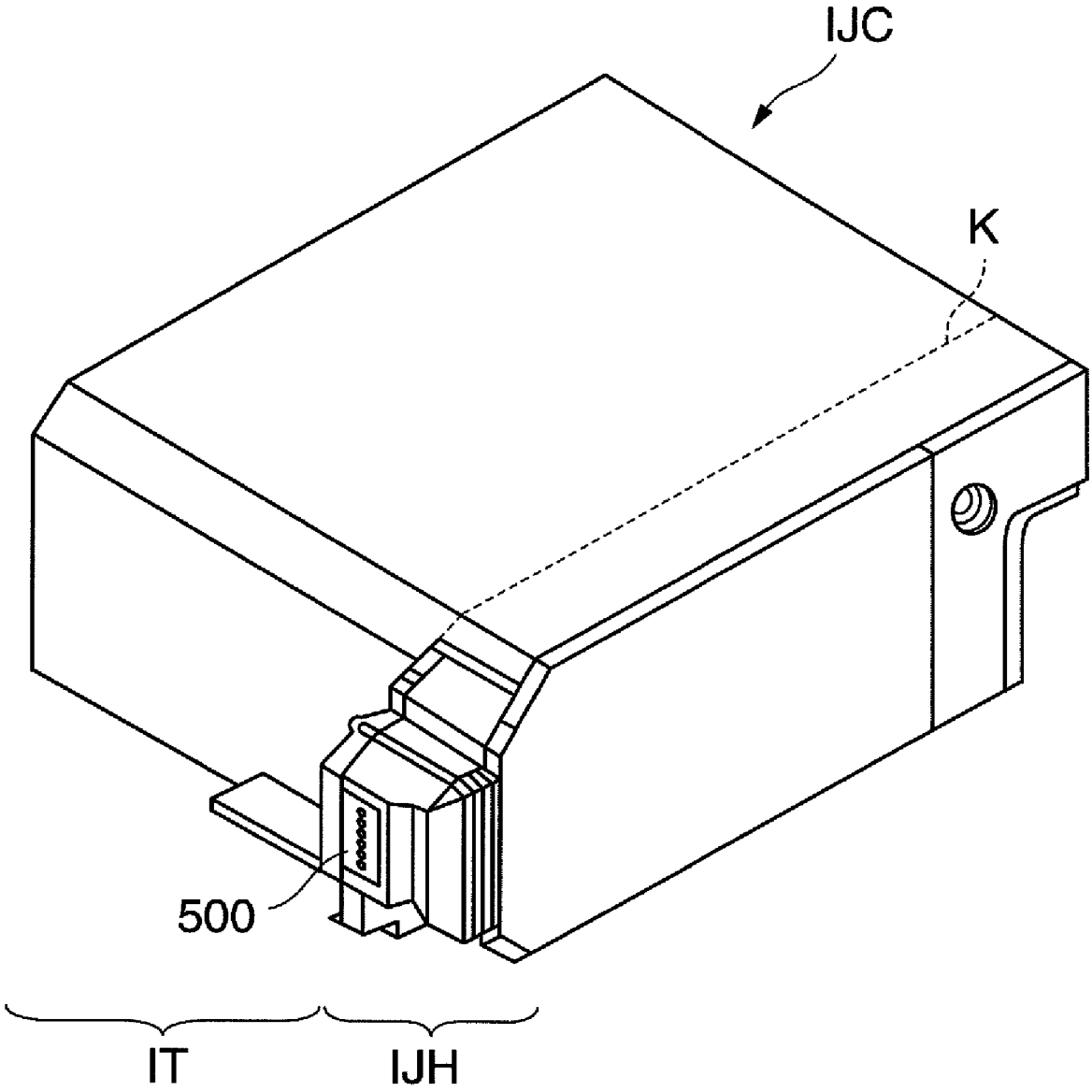
FIG. 11 is a perspective view of a general head cartridge.

FIG. 11 is an external perspective view showing the arrangement of the head cartridge IJC that integrates the ink tank and printhead. Referring to FIG. 11, a dotted line K indicates the boundary between the ink tank IT and the printhead IJH. The head cartridge IJC has an electrode (not shown) to receive an electrical signal supplied from the side of the carriage HC when the head cartridge IJC is mounted on the carriage HC. The electrical signal drives the printhead IJH to discharge ink, as described above.

Reference numeral 500 in FIG. 11 denotes an ink discharge orifice array.

First Embodiment

A preferred embodiment of the present invention will be described next with reference to the accompanying drawings.

Figure 1A:
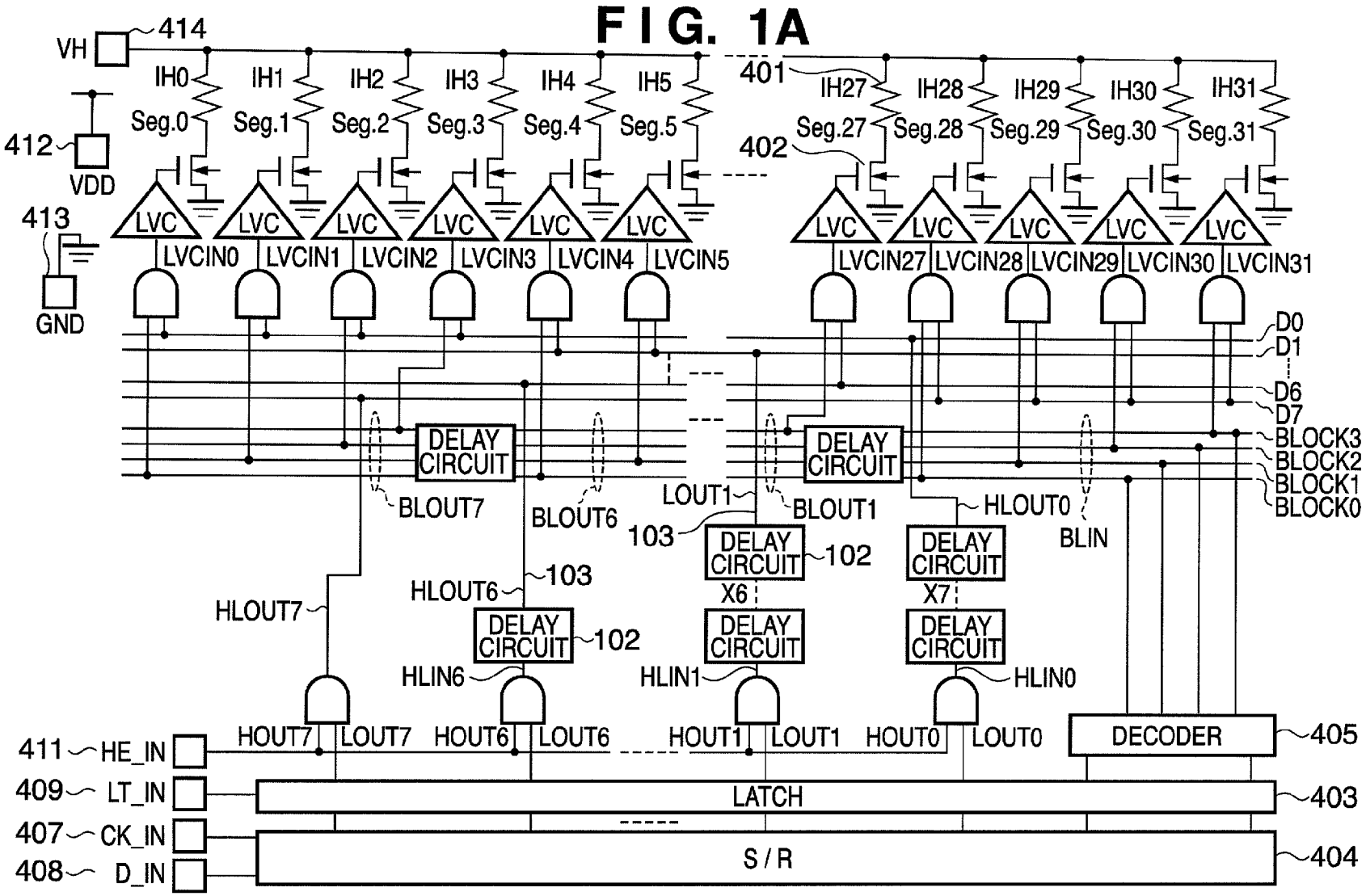
FIGS. 1A, 1B, and 1C are views showing a circuit arrangement according to the first embodiment.
Figure 1B:
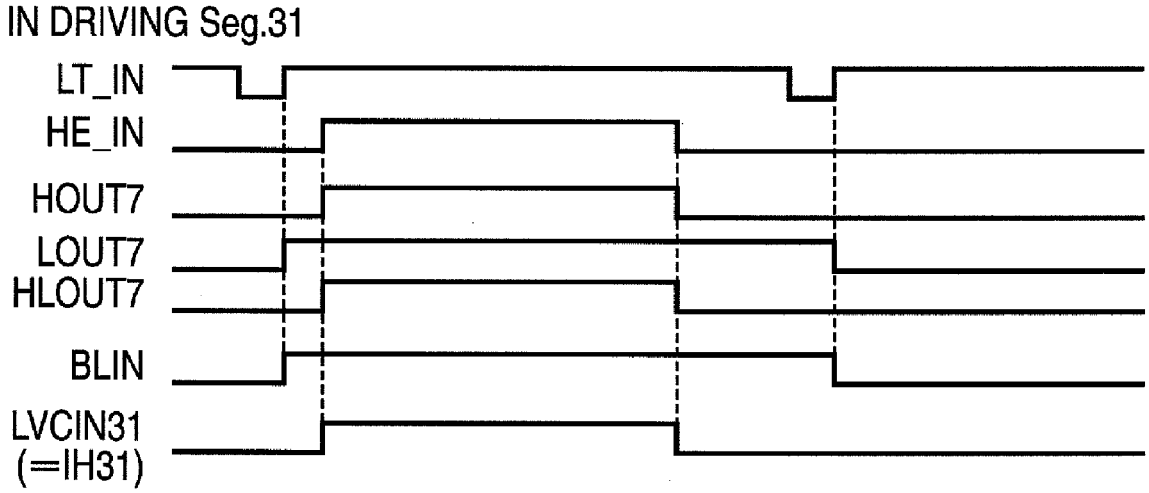
Figure 1C:
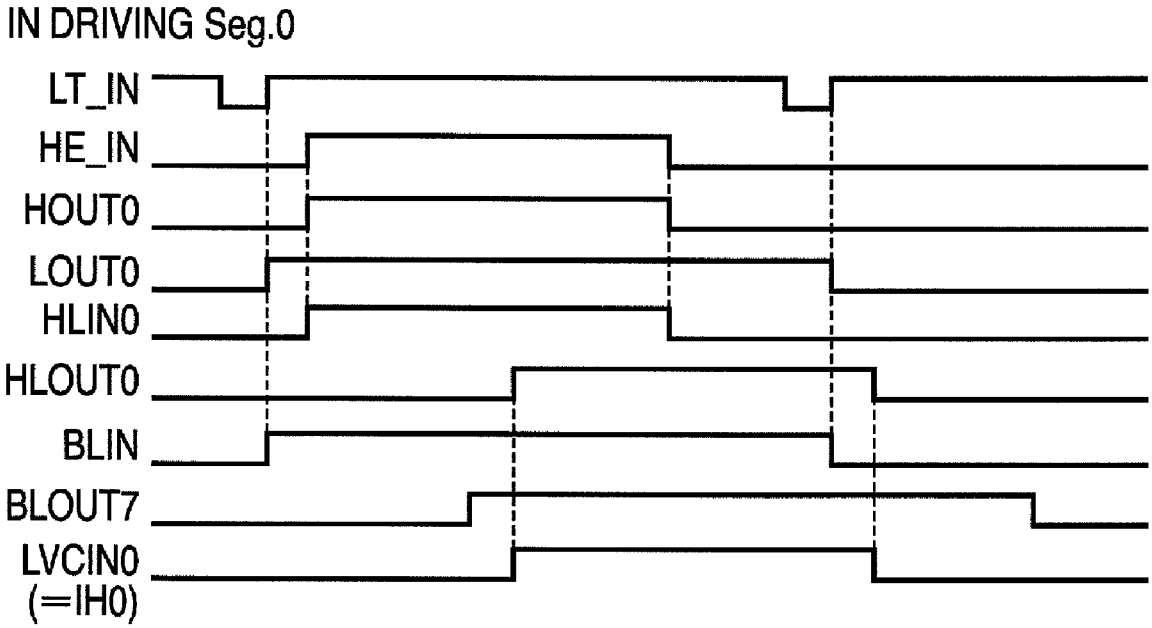

FIGS. 1A to 1C are views showing a circuit arrangement on an element substrate according to the first embodiment. More specifically, FIG. 1A is a block diagram showing the circuit arrangement. FIG. 1B is a timing chart showing a timing chart when driving Seg. (segment) 31 by using the circuit shown in FIG. 1A. FIG. 1C is a timing chart showing a timing chart when driving Seg. 0 by using the circuit shown in FIG. 1A.

HOUT* indicates a signal from HE_IN in FIG. 1A; LOUT*, a signal output through a latch circuit 403 to select D0 to D7 in FIG. 1A; and HLIN*, a signal output when HOUT* and LOUT* have passed through an AND circuit. A signal passed through a delay circuit 102 is represented by HLOUT*. Note that "*" is a corresponding integer from 0 to 7 in FIG. 1A, and "D0 to D7" indicate "data 0 to data 7". A signal output from a decoder 405 is represented by BLIN, and a signal passed through the delay circuit 102 is represented by BLOUT*. Finally, a signal of the logical product between the BLOUT* signal and the above-described HLOUT* signal, which have passed through an AND circuit serving as a heater selection circuit, is an LVCIN* signal input to an LVC. The above signal names correspond to the signal names in the timing charts of FIGS. 1B and 1C. Note that, for example, "×6" between the delay circuits 102 in FIG. 1A indicates the existence of six delay circuits 102.

Referring to FIG. 1A, a number of heaters 401 are provided on the element substrate. One terminal of each heater 401 is commonly connected to a heater driving power supply 414. The heater 401 represents a printing element of this embodiment. In this embodiment, the heater 401 is used as a printing element. But another type of printing element can be used. The other terminal of each heater 401 is grounded through a power transistor 402 provided for each heater 401. The power transistor 402 functions as the switch of the heater 401. The power transistor 402 represents a driving circuit of the present invention. Logic circuits such as the latch circuit (LATCH) 403 and a shift register (S/R) 404 are provided on the element substrate. To reduce the number of heaters 401 to be driven simultaneously and decrease the current that instantaneously flows, logic circuits such as the decoder (DECODER) 405 and a logic buffer (not shown) having a hysteresis characteristic are also formed on the element substrate. The decoder 405 is a logic circuit for selecting a block to be time-divisionally driven and represents a time-divisional selection circuit of the present invention. This logic circuit is provided to divide the heaters into blocks each including a predetermined number of heaters and divisionally drive the blocks. An electrostatic protection element and the like may be provided on the element substrate, although not illustrated in FIG. 1A.

Input signals to the element substrate are as follows. A clock signal (CK_IN) drives the shift register. A data (D_IN) serially arranges data containing a block selection data and a print data to specify heaters to be driven. A latch signal (LT_IN) causes the latch circuit to hold data. A heat pulse signal (HE_IN) is an enable signal to externally control (define) the ON time of a power transistor, that is, the driving period of a heater. Inputs from a logic circuit driving power supply (VDD) and a heater driving power supply (VH) and an output to ground (GND) also exist. The signals are input through pads 407, 408, 409, 411, 412, 413, and 414 on the element substrate. An AND circuit which is a driving logic circuit serving as a heater selection circuit to selectively drive a power transistor calculates the logical product of the heat pulse signal, the signal (print data signal) output from the latch circuit 403, and the signal (block selection signal) output from the decoder 405 for each power transistor. The AND circuit controls the power transistor 402 and applies a driving pulse to the heater 401 in accordance with the calculation result.

The driving sequence of printing using the inkjet printhead element substrate will be described below. First, the printing apparatus main body serially transmits, to the element substrate in the printhead, a data based on data containing a block selection data and a print data to specify heaters to be driven in synchronism with the clock signal. The data is input to the shift register 404 in the element substrate. The latch circuit 403 stores the data input to the shift register 404 in accordance with the externally input latch signal LT. The decoder 405 selects a block to be time-divisionally driven before the latch circuit holds the next print data. One of a plurality of power transistors 402 is specified by print data in the ON state and the block selected in accordance with the heat pulse signal input from the heat pulse signal input pad 411, and turned on. A current (driving pulse) flows to the heaters 401 corresponding to the power transistors in the ON state and drives the heaters.

In this embodiment, the delay circuits (Delay Circuit) 102 are provided to drive the heaters belonging to the same block at slightly different timings. The delay circuits 102 delay the heat pulse signal input based on the heat pulse signal input from the heat pulse signal input pad 411. In this case, the signal HLOUT* output from the AND circuit is sequentially delayed, thereby delaying even the print data signal together with the heat pulse signal, as will be described later (this case will also be expressed as "the print data signal and heat pulse signal are delayed"). The delayed heat pulse signals drive the different heaters 401 in the same block at slightly different timings. The delay circuits constitute a delay means. The element substrate of the present invention synchronizes the heat pulse signal and delay time even for a print data signal (output signal from the latch circuit 403) to select heaters to be driven and a signal (block selection signal output from the decoder 405) based on block selection information. That is, the delay circuits 102 output heat pulse signals, which correspond to heaters in number smaller by one than the number of heaters included in the same block, to heat pulse signal lines 103 corresponding to the heaters.

In FIG. 1A, each group which receives one of the data D0 to D7 includes four heaters 401. That is, the heaters 401 are divided into a total of eight groups. The heaters 401 are represented by IH0 to IH31 for convenience. An undelayed heat pulse signal input from the heat pulse signal input pad 411 is supplied to the heaters IH28 to IH31 through an AND circuit.

For the heaters IH24 to IH27, the logical product of a heat pulse signal (HOUT6 in FIG. 1A) input from the heat pulse input pad 411 and an image data signal as the output signal (LOUT6 in FIG. 1A) from the latch circuit 403 is calculated by the AND circuit and supplied through one delay circuit 102.

A signal (block selection signal) which is output from the decoder 405 to select one of the heaters IH24 to IH27 is output through one delay circuit 102. The logical product of the block selection signal and the output signal obtained by calculating the logical product between the heat pulse signal and the output signal from the latch circuit 403 is calculated. With this operation, a pulse signal to drive desired heaters is supplied to the gates of the power transistors 402 through LVCs (level converters).

Similarly, for the heaters IH20 to IH23, the logical product of the heat pulse signal and the output signal from the latch circuit 403 is calculated and output through two delay circuits 102 and an AND circuit. A signal which is output from the decoder 405 to select one of the heaters IH20 to IH23 is also output through two delay circuits 102 included in the delay means. The logical product of that signal and the output signal obtained by calculating the logical product between the heat pulse signal and the latch circuit output signal is calculated. With this operation, a pulse signal to drive desired heaters is supplied to the gates of the power transistors 402 through LVCs (level converters).

Even for the heaters IH16 to IH19, the logical product of the heat pulse signal and the print data signal from the latch circuit 403 is calculated and output through three delay circuits 102. A signal which is output from the decoder 405 to select one of the heaters IH16 to IH19 is also output through three delay circuits 102.

Finally, heat pulse signals obtained by delaying the heat pulse signal input to the heat pulse signal input pad 411 by using one to three delay circuits 102 are supplied to the heaters IH24 to IH27, IH20 to IH23, and IH16 to IH19 through the power transistors 402. The signal to be input to the heaters IH0 to IH3 is delayed by seven delay circuits 102, that is, delay circuits smaller by one in number than the total number of groups.

In this way, the signal obtained by calculating the logical product of the heat pulse signal and the print data signal, that is, the output signal from the latch circuit is delayed by the delay circuit serving as a delay means. This indicates that the print data signal is also delayed in accordance with (in synchronism with) the delayed heat pulse signal. Since the print data signal is delayed, when the print data in the latch circuit is switched by inputting of the next latch signal, the print data input to the AND circuit isn't switched immediately. Actually, this always prevents the heat pulse signal from exceeding a designated period defined by an input period of the latch signal.

In this embodiment, the signal (in this arrangement, the print data signal from the latch circuit 403) to select appropriate heaters is also delayed, like the heat pulse signal. The block selection signal (in this arrangement, the output signal from the decoder 405) used to select a block is also delayed by the delay circuit 102. The heat pulse signal output from the delay circuit 102, and the print data signal to select appropriate heaters and the block selection signal to select a block are delayed almost in synchronism with each other. This arrangement solves the above-described problem, that is, prevents switching to another heater halfway during input of the heat pulse signal. That the heat pulse signal partially lacks its latter half indicates that the heat pulse signal input from the heat pulse signal input pad 411 is input to the power transistor 402 as a heat pulse signal having a partially missing part. Although not described in this embodiment, when the element sizes and load amounts of the heat pulse signal delay circuit and latch signal delay circuit are almost equalized, the arrangement can cope with a variation in the delay amount caused by process/manufacturing variations.

In this embodiment, the signal of the logical product between the heat pulse signal and the print data signal from the latch circuit is delayed, as described above. This indicates that the heat pulse signal and print data signal are set to the same delay amount.

A detailed timing chart when driving Seg. 31 will be described next with reference to FIG. 1B. In this embodiment, LT_IN is through at Low and active at High. To indicate that each segment is selected every predetermined period, LT_IN (Low signal) is input twice. HE_IN with a desired pulse width is input between the two input signals LT_IN. HE_IN is input to the first (leftmost in FIG. 1A) AND circuit as HOUT7. Similarly, a signal for D7, which is output from the latch circuit 403 to drive Seg. 31, is input to the first AND circuit as LOUT7. A signal obtained by calculating the logical product of HOUT7 and LOUT7 is output as HLOUT7 without passing through the delay circuit 102, that is, at the same timing as HOUT7. On the other hand, the decoder 405 outputs block selection signals to select BLOCK0 to BLOCK3. In this example, Seg. 31 should be driven. Hence, the signal to select BLOCK3 is input as BLIN. Finally, the logical product of BLIN and HLOUT7 is calculated. A signal LVCIN31 obtained by calculating the logical product is input to a desired LVC. The gate of the driver transistor connected to the LVC that has received LVCIN31 is turned on. Hence, in this example, the heater IH31 of Seg. 31 is turned on.

A detailed timing chart when driving Seg. 0 will be described next with reference to FIG. 1C. LT_IN is through at Low and active at High, as described above, and the operation method is the same. HE_IN with a desired pulse width is input between two input signals LT_IN. HE_IN is input to the first (rightmost in FIG. 1A) AND circuit as HOUT0. Similarly, a signal for D0, which is output from the latch circuit 403 to drive Seg. 0, is input to the first AND circuit as LOUT0. A signal obtained by calculating the logical product of HOUT0 and LOUT0 is input to the delay circuit 102 as HLIN0 while keeping the same pulse width as that of HOUT0. The signal is delayed through the delay circuits 102 included in the delay means and output as HLOUT0. At this time, the signal is delayed seven steps by passing through seven delay circuits. On the other hand, the decoder 405 outputs a block selection signal to select a block. In this example, Seg. 0 should be driven. Hence, the signal to select BLOCK0 is output as BLIN. The signal BLIN is output as BLOUT7 at almost the same timing as the output timing of HLOUT0 which is output through the delay circuits 102 as many as those of HLIN0. Finally, the logical product of BLOUT7 and HLOUT0 is calculated. A signal LVCIN0 obtained by calculating the logical product is input to a desired LVC. The gate of the driver transistor connected to the LVC that has received LVCIN0 is turned on. Hence, in this example, the heater IH0 of Seg. 0 is turned on.

In the above description, the delay amount of the signal BLIN is represented by the number of circuits equal to the number of delay circuits through which the signal HLIN0 passes through. However, it need not always be represented by the number of circuits. The delay amounts need only be the same (almost the same) within a normally operable range.

Second Embodiment

A circuit arrangement according to the second embodiment will be described next with reference to FIGS. 6A to 6C.

Figure 6A:
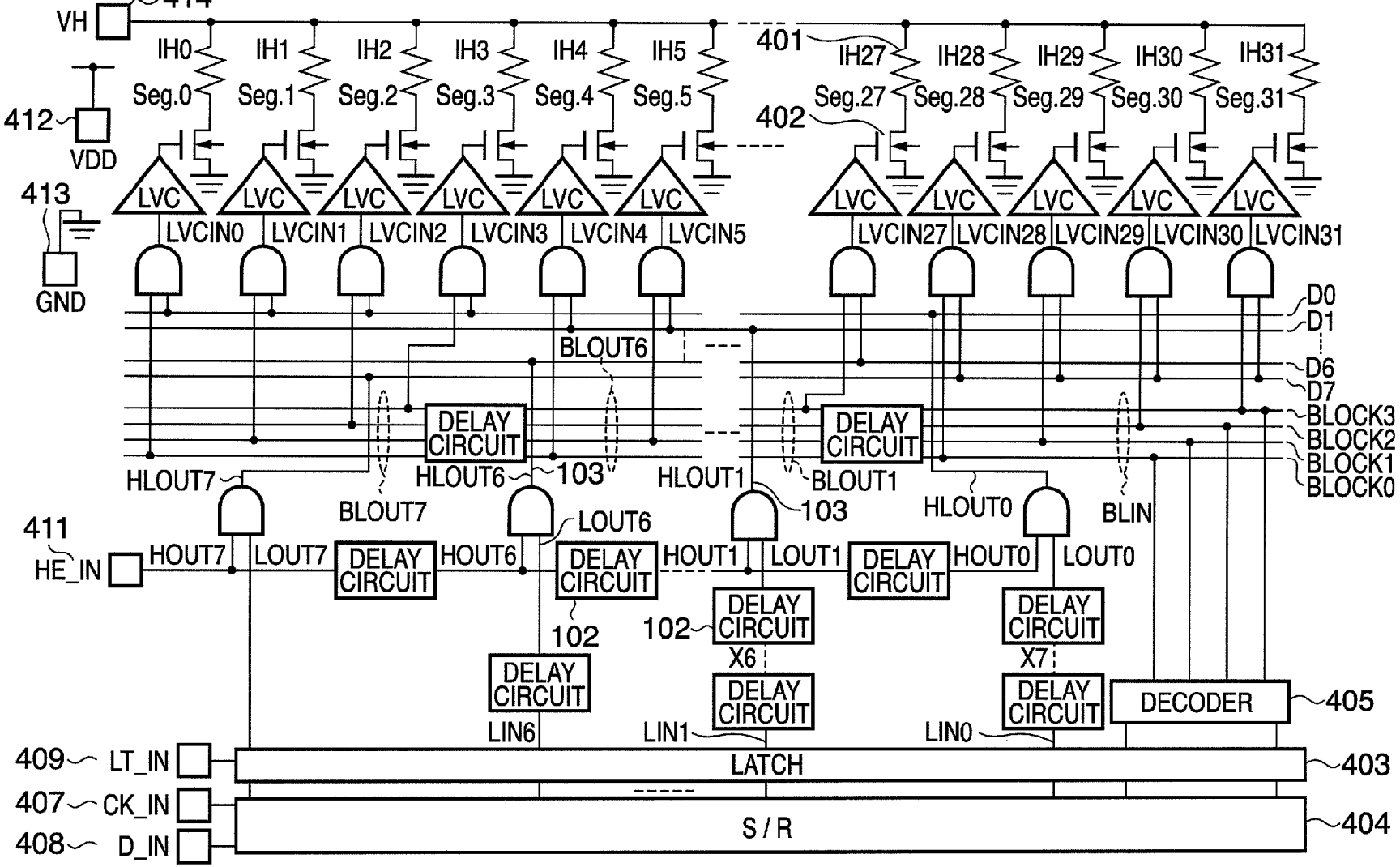
FIGS. 6A, 6B, and 6C are views showing a circuit arrangement according to the second embodiment.

FIG. 6A is a block diagram showing the circuit arrangement. FIG. 6B is a timing chart when driving Seg. 31 by using the circuit shown in FIG. 6A. FIG. 6C is a timing chart when driving Seg. 0 by using the circuit shown in FIG. 6A.

FIG. 6A will be described. A description of parts common to FIG. 1A will not be repeated.

As a characteristic feature of the element substrate shown in FIG. 6A, the output signal (print data signal) from a latch circuit 403, the output signal (block selection signal) from a decoder 405, and the heat pulse signal are input to delay circuits 102. The delay circuits 102 delays these signals in synchronism with each other.

In this embodiment, for heaters IH28 to IH31, an undelayed heat pulse signal input from a heat pulse signal input pad 411 is directly supplied through an AND circuit, as in the first embodiment.

For heaters IH24 to IH27, the heat pulse signal input from the heat pulse input pad 411 is output to an AND circuit as HOUT6 through one delay circuit 102 included in the delay means. The print data signal from the latch circuit 403 is also output to the AND circuit as LOUT6 through one delay circuit 102, like HOUT6. The AND circuit calculates the logical product of HOUT6 and LOUT6.

Similarly, for heaters IH20 to IH23, the heat pulse signal input from the heat pulse signal input pad 411 is output to an AND circuit as HOUT5 through a total of two delay circuits 102. The output signal from the latch circuit 403 is also output to the AND circuit as LOUT5 through a total of two delay circuits 102, like HOUT5. The AND circuit calculates the logical product of HOUT5 and LOUT5.

For heaters IH16 to IH19, the heat pulse signal input from the heat pulse signal input pad 411 is output to an AND circuit as HOUT4 through a total of three delay circuits 102. The output signal from the latch circuit 403 is also output to the AND circuit as LOUT4 through a total of three delay circuits 102, like HOUT4. The AND circuit calculates the logical product of HOUT4 and LOUT4.

Finally, heat pulse signals obtained by delaying the heat pulse signal input from the heat pulse signal input pad 411 by using one to three delay circuits 102 are input to the heaters IH24 to IH27, IH20 to IH23, and IH16 to IH19 through power transistors 402. The signal to be input to heaters IH0 to IH3 is delayed by seven delay circuits 102, that is, delay circuits smaller by one in number than the total number of blocks.

In this embodiment, the print data signal output from the latch circuit 403 to select appropriate heaters and the block selection signal are delayed by the delay circuit 102, like the heat pulse signal, as in the first embodiment. This synchronizes the heat pulse signal output from the delay circuit 102 with the output signal (print data signal) from the latch circuit 403 and the signal (block selection signal) to select a block, which are output from the delay circuit 102. The thus delayed heat pulse signal falls within the designated period of the print signal, which is defined by the period of the latch signal, or the block designated period of the block selection signal. It is therefore possible to solve the above-described problem.

Referring to FIG. 6A, HOUT* indicates a signal from HE_IN; LIN*, a signal output through the latch circuit 403 to select D0 to D7; LOUT*, a signal output when LIN* has passed through the delay circuit 102; and HLOUT*, a signal output when HOUT* and LOUT* have passed through an AND circuit. A signal output from the decoder 405 is represented by BLIN, and a signal passed through the delay circuit 102 is represented by BLOUT*. A signal obtained by calculating the logical product of the BLOUT* signal and the above-described HLOUT* signal is an LVCIN* signal input to an LVC. The above signal names correspond to the signal names in the timing charts of FIGS. 6B and 6C.

Figure 6B:
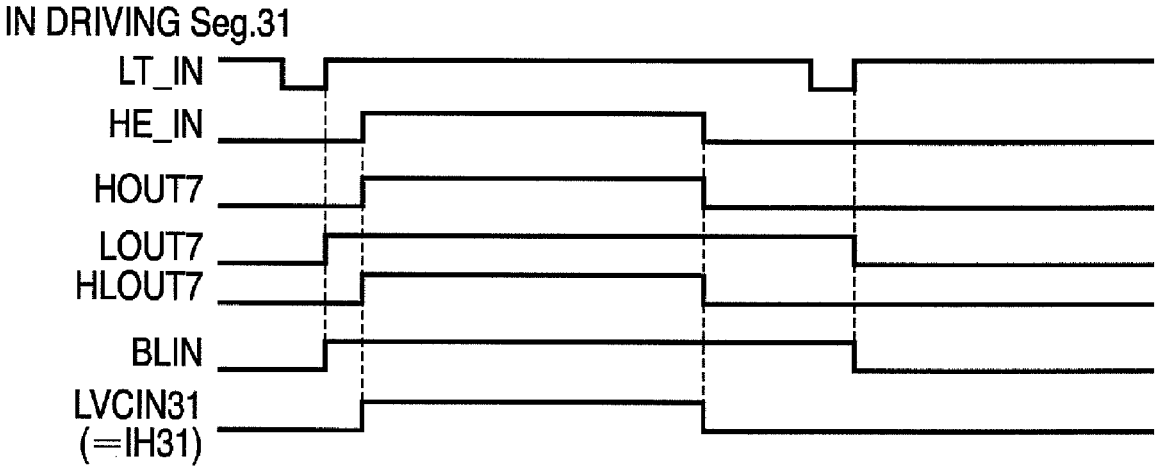
Figure 6C:
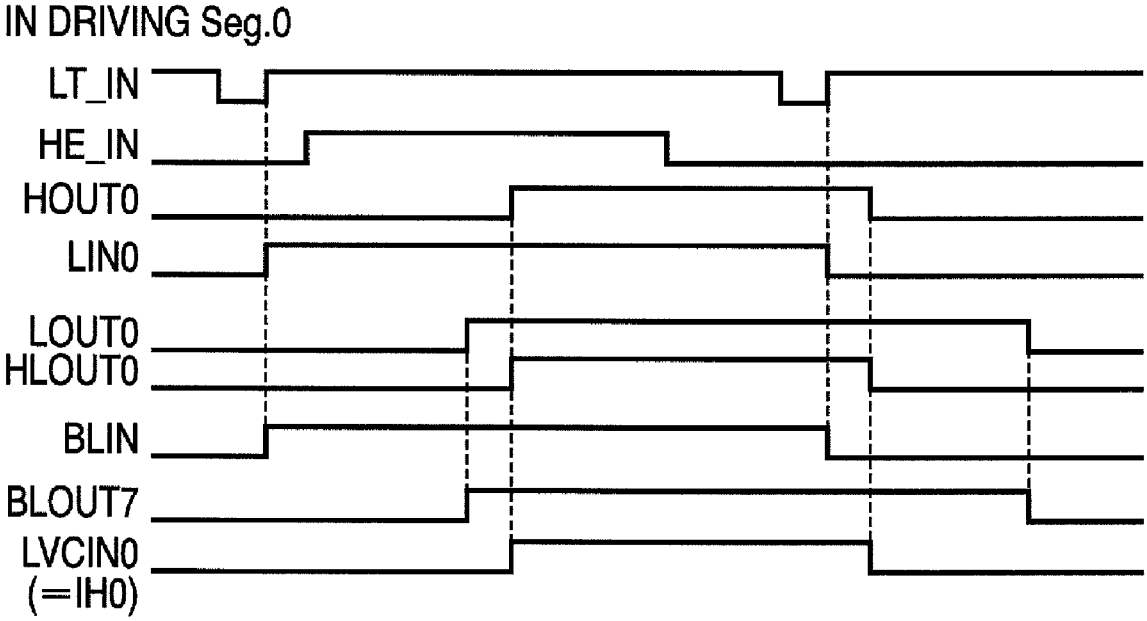

FIG. 6B shows a detailed timing chart when driving Seg. 31 in FIG. 6A of this embodiment. This is the same as the timing chart shown in FIG. 1B of the first embodiment when driving Seg. 31, and a description thereof will not be repeated.

A detailed timing chart when driving Seg. 0 in FIG. 6A of this embodiment will be described next with reference to FIG. 6C. LT_IN is through at Low and active at High, as described above, and the operation method is the same as described with reference to FIG. 1B. HE_IN with a desired pulse width is input between two input signals LT_IN. HE_IN is input to the first AND circuit as HOUT0 through a plurality of delay circuits 102. Similarly, a signal for D0 is output from the latch circuit 403 as LIN0 to drive Seg. 0. LIN0 is also input to the first AND circuit as LOUT0 through a plurality of delay circuits 102 which are the same as those of HE_IN. A signal obtained by calculating the logical product of HOUT0 and LOUT0 is output as HLOUT0. On the other hand, the decoder 405 outputs a signal to select a block. In this example, Seg. 0 should be driven. Hence, the signal to select BLOCK0 is output as BLIN. The signal BLIN is output as BLOUT7 through the delay circuits 102 as many as those of the HOUT0 or LOUT0 signal at almost the same timing as the output timing of HLOUT0. Finally, the logical product of BLOUT7 and HLOUT0 is calculated. A signal LVCIN0 obtained by calculating the logical product is input to a desired LVC. The gate of the driver transistor connected to the LVC that has received LVCIN0 is turned on. Hence, in this example, the heater IH0 of Seg. 0 is turned on.

Third Embodiment

A circuit arrangement according to the third embodiment will be described next with reference to FIG. 7.

Figure 7:
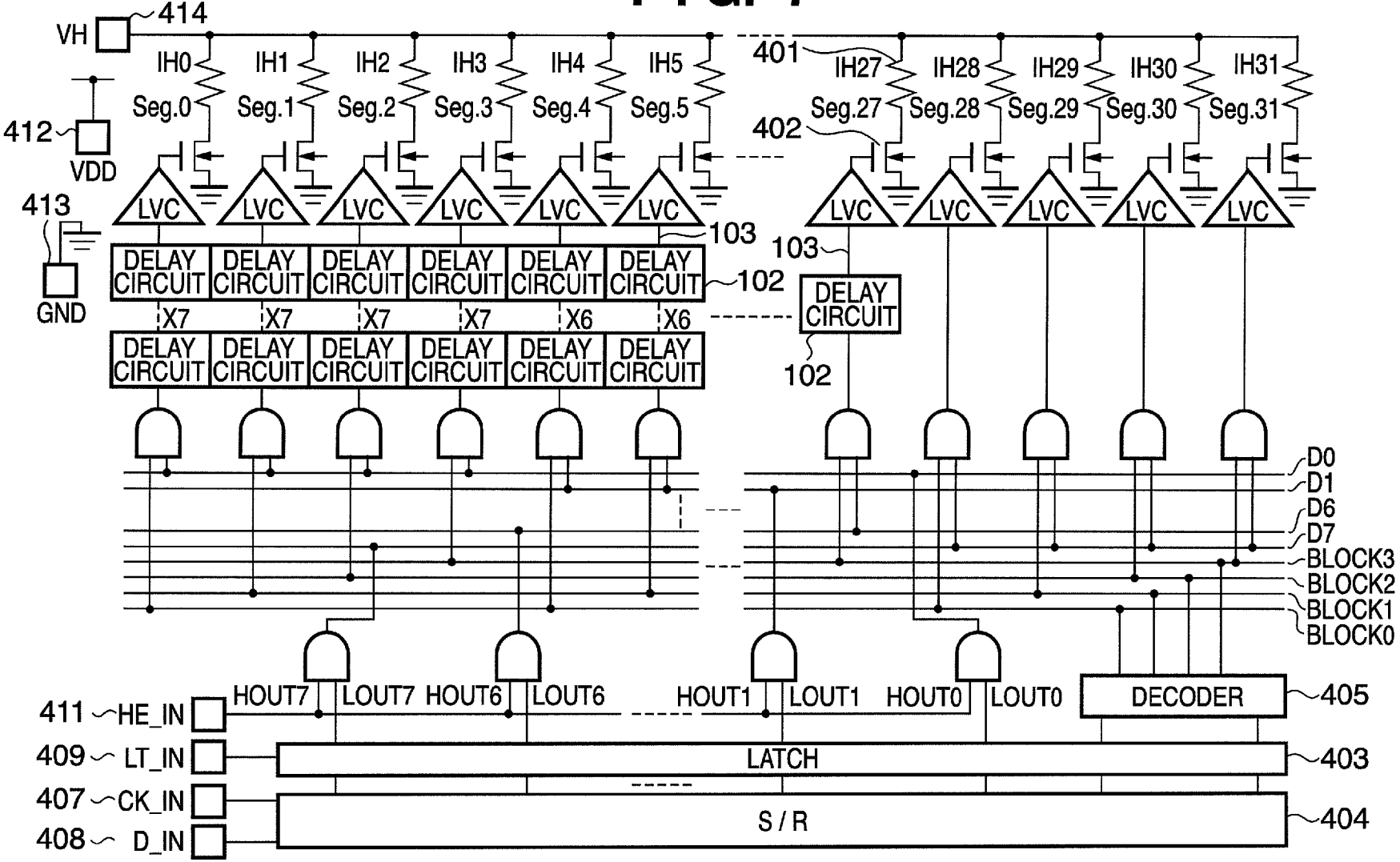
FIG. 7 is a block diagram showing a circuit arrangement according to the third embodiment.

The elements and driving method of an element substrate shown in FIG. 7 are basically the same as those of the above-described element substrates in FIGS. 1A and 6A, and a detailed description thereof will not be repeated. As a characteristic feature of the element substrate shown in FIG. 7, all logical products of the heat pulse signal input from a heat pulse signal input pad 411, the output signal from a latch circuit 403, and the output signal from a decoder 405 are calculated. After that, the signal obtained by calculating the logical product is delayed.

Supplementary Explanation of First to Third Embodiments

A detailed arrangement of the above-described delay circuit 102 will be explained next.

Figure 2A:
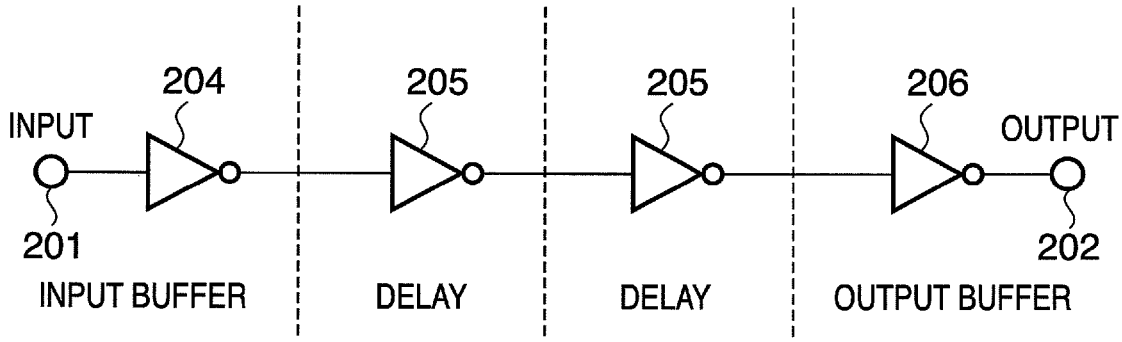
FIGS. 2A and 2B are circuit diagrams showing an example of a delay circuit.
Figure 2B:
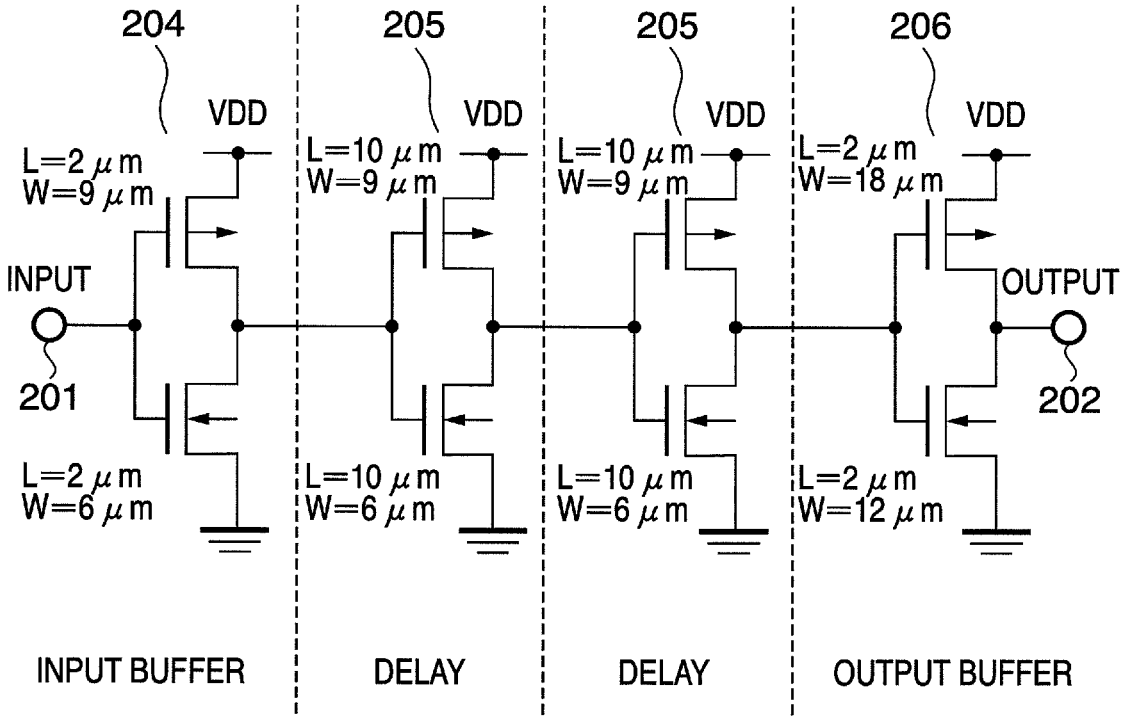

As the delay circuit 102, an inverter delay circuit is usable. The inverter delay circuit is formed by combining a plurality of inverter circuits which are formed by the same film formation process as the drive control logics including the shift register 404 and latch circuit 403. FIGS. 2A and 2B show an example of the delay circuit 102. FIG. 2A shows the elements of the delay circuit 102 as blocks. FIG. 2B shows a more detailed arrangement of the elements.

As shown in FIG. 2A, the delay circuit 102 includes an input buffer 204, two delays 205 having a cascade arrangement, and an output buffer 206. Each of the input buffer 204, delays 205, and output buffer 206 is formed from a CMOS (Complementary Metal Oxide Semiconductor) inverter circuit. Since the two delays 205 are included, the delay circuit 102 is regarded as a circuit with a cascade arrangement of four inverter circuits.

In the input buffer 204 and output buffer 206 of the delay circuit, a gate length (channel length) L of each of MOS transistors (p-channel and n-channel MOS transistors) included in the inverter is 2 μm, as shown in FIG. 2B. This length equals the gate length of each MOS transistor included in the drive control logics including the shift register 404 and latch circuit 403. In the delay 205, the gate length L is 10 μm, that is, longer than the gate length (2 μm) of each MOS transistor of the logics so that a sufficient delay is obtained. A gate width (channel width) W in the delay 205 has the same value (e.g., 6 μm for an NMOS transistor, and 9 μm for a PMOS transistor) as in the input buffer 204. In the output buffer 206, the gate width W is 12 μm for an NMOS transistor and 18 μm for a PMOS transistor.

In the first to third embodiments, a block includes eight elements of heaters 401. Eight heat pulse signal lines 103 are formed by providing 0 to 7 delay circuits 102 on the line portion of the heat pulse signal from the heat pulse signal input pad 411. Wiring is done such that the actual transmission time of the heat pulse signal changes by 10 ns between the eight elements of heaters 401 simultaneously selected by the decoder 405 serving as a block selection circuit. The operation of this embodiment will be described assuming that all heaters. IH0 to IH31 in FIG. 1A are selected and driven. That is, when all signals output from the latch circuit 403 in correspondence with the heaters are active, and the heat pulse signal is at high level, the power transistors 402 are turned on to flow a current as a driving pulse to the heaters 401.

The heaters IH28 to IH31 are driven by an undelayed heat pulse signal input to the heat pulse signal input pad 411. A heat pulse signal obtained by delaying the heat pulse signal to the heaters IH28 to IH31 are input to the heaters IH24 to IH27. In this case, the actual time when the heat pulse signal to the heaters IH24 to IH27 exceeds the threshold value of the power transistors 402, and a current starts flowing to (turns on) the heaters IH24 to IH27 is delayed from the time when a current starts flowing to the heaters IH28 to IH31. Similarly, the time when a current starts flowing to the heaters IH20 to IH23 and the time when a current starts flowing to the heaters IH16 to IH19 are also sequentially delayed. For this reason, the current pulse flowing to the heater driving power supply line has a stepwise form. That is, the current change amount per unit time is not much different from that when a single heater is turned on, and the noise level greatly lowers.

In the element substrate of this embodiment, the heat pulse signal is delayed not by a CR integrating circuit but by a logic circuit such as a CMOS inverter. For this reason, the current flowing to the heaters can accurately be controlled while minimizing the variation in the delay amount. It is therefore possible to further suppress the amount of noise generation. In addition, a CMOS inverter can be made smaller than a CR integrating circuit on a silicon semiconductor substrate. Hence, the element substrate of this embodiment can be smaller than a conventional element substrate. This reduces cost and improves the productivity.

In this embodiment, a case wherein eight heaters are simultaneously selected as a block, and the heat pulse signal input time shifts for every heater has been exemplified. However, the number of heaters included in one block can appropriately be determined. Several heaters may be combined within the bounds of not raising the problem of noise level, and the heat pulse signal may be input to these heaters at the same timing. In the present invention, the delay time of the delay circuit formed from inverters is adjusted, and appropriate wiring is done. This arrangement can cope with any case independently of the number of heaters to be turned on simultaneously, as a matter of course.

The delay circuits 102 using inverters are formed on a silicon semiconductor substrate by a film formation process together with the heaters, drivers, drive control logics including the shift register and latch circuit, input pads, and the decoder 405 serving as a block selection circuit. For this reason, the delay circuits can be formed without changing the manufacturing process of the element substrate. Since the number of pads of the input unit on the element substrate and other circuit arrangement in the element substrate need not be changed largely, the cost of the element substrate itself rarely rises even when the delay circuits 102 are formed, as described above. Additionally, since the printhead can have the measure against noise, the remaining parts need not include a component such as a capacitor serving as a measure against noise. Hence, the apparatus main body can be inexpensive and compact.

Figure 8:
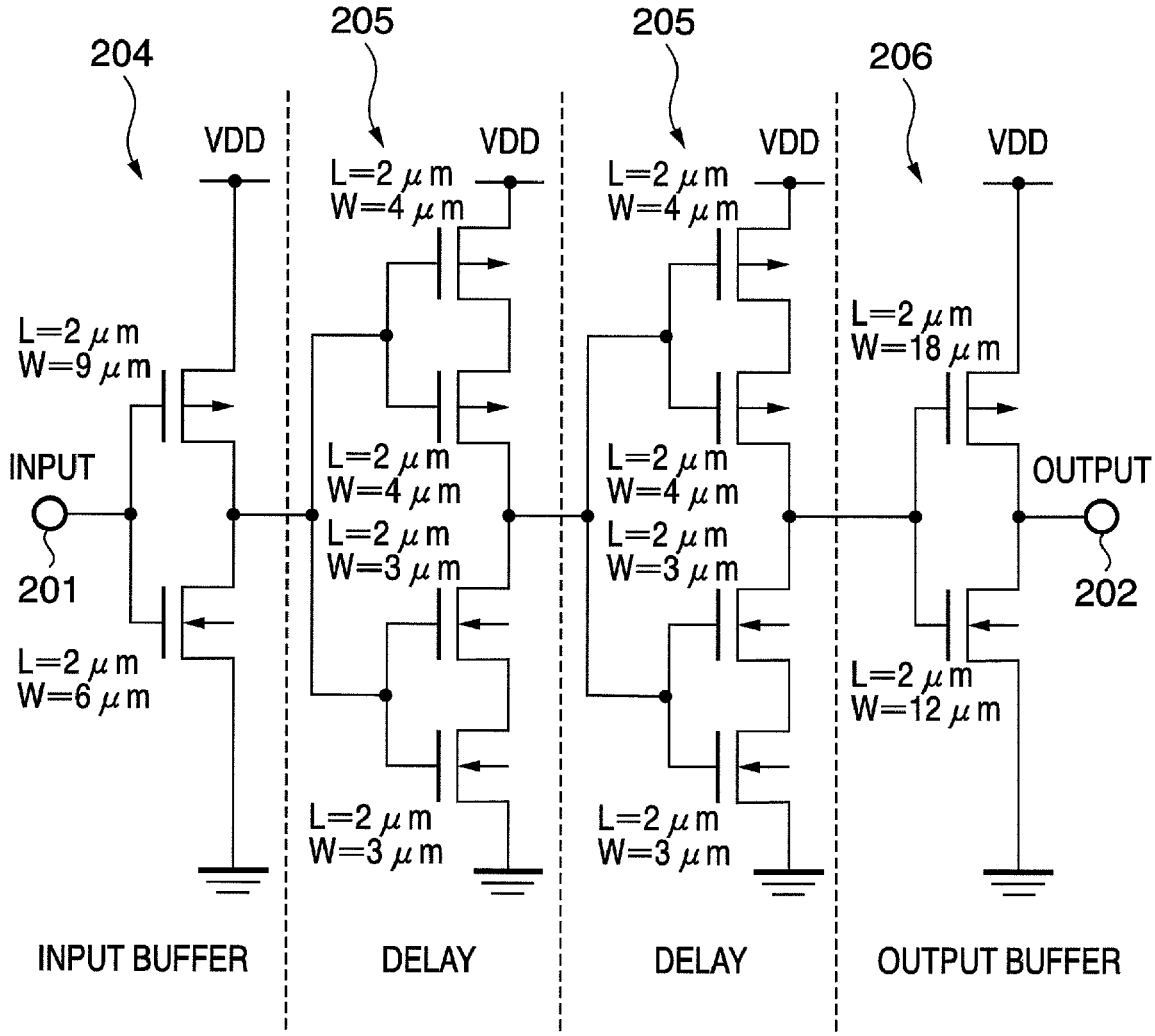
FIG. 8 is a circuit diagram showing another example of the delay circuit.

In the present invention, the delay circuit 102 for delaying the heat pulse signal is not limited to that shown in FIGS. 2A and 2B. FIG. 8 shows another example of the delay circuit 102.

The delay circuit 102 shown in FIG. 8 includes the input buffer 204, two delays 205, and output buffer 206 each formed from a CMOS inverter circuit, like the delay circuit 102 in FIGS. 2A and 2B. The arrangement of the delay 205 is different from that shown in FIG. 2B. In the delay circuit 102 shown in FIG. 8, to increase the delay amount of the delay 205 as a CMOS inverter circuit, the NMOS transistor of the normal CMOS inverter circuit shown in FIG. 2B is replaced with two NMOS transistors having a cascade arrangement. In addition, the PMOS transistor is replaced with two PMOS transistors having a cascade arrangement. The output from the inverter of the preceding step is commonly supplied to the gates of the MOS transistors.

This arrangement allows obtaining a sufficient delay time without increasing the gate (channel) length L of each MOS transistor. Particularly, the gate length L of each MOS transistor included in the delay circuit 102 can easily be made equal to the gate length of each MOS transistor of the drive control logics including the shift register 404 and latch circuit 403. This facilitates circuit design and layout design of the element substrate as a semiconductor device or integrated circuit.

The three embodiments of the present invention have been described above. In addition, various combinations are available in accordance with conditions such as the layout of the element substrate, the number of blocks, the number of delay divisions, the number of bits to be driven simultaneously, and the order and configuration of delay. The present invention can be achieved by combining them appropriately in accordance with the chip size and layout.

The delay time of the delay circuit 102 is preferably adjusted not to make the drive time of the printing elements of a single block exceed the drive time allotted to one block.

The printing apparatus of the present invention can take the form of an integrated or separate image output terminal of an information processing device such as a computer. Alternatively, the printing apparatus may take the form of a copying machine combined with a reader or the form of a facsimile apparatus having a transmission/reception function.

The embodiments have been described by exemplifying an element substrate for an inkjet printhead. However, the element substrate is also usable for a thermal transfer printhead or sublimation printhead.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-307222, filed Nov. 13, 2006, which is hereby incorporated by reference herein in its entirety.

What is claimed is:

1. A printhead element substrate including a plurality of printing elements, a plurality of driving circuits which drive said plurality of printing elements, input means for inputting an enable signal to define a driving period of each printing element, a shift register which inputs a print data, a latch circuit which stores, in accordance with an externally input latch signal, the print data output from said shift register and outputs a print data signal, and a time-divisional selection circuit which generates a block selection signal to divide said plurality of printing elements into a plurality of blocks and time-divisionally drive said printing elements, comprising:

delay means for changing a drive timing between printing elements in a single block, said delay means delaying the enable signal and the print data signal.

2. The substrate according to claim 1, wherein said delay means includes a first delay circuit which delays a signal obtained by calculating a logical product of the enable signal and the print data signal, and a second delay circuit which delays the block selection signal.

3. The substrate according to claim 2, wherein said first delay circuit and said second delay circuit delay the signals to make the signal delayed by said first delay circuit fall within a block designated period of the block selection signal delayed by said second delay circuit.

4. The substrate according to claim 1, wherein said delay means includes a first delay circuit which delays the enable signal, a second delay circuit which delays the print data signal output from said latch circuit, and a third delay circuit which delays the block selection signal.

5. The substrate according to claim 1, wherein said delay means includes a delay circuit which delays a signal obtained by calculating a logical product of the block selection signal and a signal obtained by calculating a logical product of the enable signal and the print data signal, and outputs the delayed signal.

6. The substrate according to claim 1, wherein said delay means is formed by connecting in series delay circuits whose number changes between the blocks.

7. The substrate according to claim 1, wherein said delay means is formed by connecting an even number of CMOS inverter circuits in series.

8. The substrate according to claim 7, wherein said CMOS inverter circuits included in said delay means have the same load.

9. The substrate according to claim 1, wherein said time-divisional selection circuit comprises a decoder, and the block selection signal is a signal output from the decoder.

10. The substrate according to claim 1, wherein the signal from said shift register is input to said time-divisional selection circuit.

11. A printhead which has an element substrate including a plurality of printing elements, a plurality of driving circuits which drive said plurality of printing elements, input means for inputting an enable signal to define a driving period of each printing element, a shift register which inputs a print data, a latch circuit which stores, in accordance with an externally input latch signal, the print data output from said shift register and outputs a print data signal, and a time-divisional selection circuit which generates a block selection signal to divide said plurality of printing elements into a plurality of blocks and time-divisionally drive said printing elements, the element substrate comprising:

delay means for changing a drive timing between printing elements in a single block, said delay means delaying the enable signal and the print data signal.

12. A head cartridge which has a printhead including an element substrate including a plurality of printing elements, a plurality of driving circuits which drive said plurality of printing elements, input means for inputting an enable signal to define a driving period of each printing element, a shift register which inputs a print data, a latch circuit which stores, in accordance with an externally input latch signal, the print data output from said shift register and outputs a print data signal, and a time-divisional selection circuit which generates a block selection signal to divide said plurality of printing elements into a plurality of blocks and time-divisionally drive said printing elements, and an ink tank which contains ink, the element substrate comprising:

delay means for changing a drive timing between printing elements in a single block, said delay means delaying the enable signal and the print data signal.

13. A printing apparatus which has a printhead including an element substrate including a plurality of printing elements, a plurality of driving circuits which drive said plurality of printing elements, input means for inputting an enable signal to define a driving period of each printing element, a shift register which inputs a print data, a latch circuit which stores, in accordance with an externally input latch signal, the print data output from said shift register and outputs a print data signal, and a time-divisional selection circuit which generates a block selection signal to divide said plurality of printing elements into a plurality of blocks and time-divisionally drive said printing elements, the element substrate comprising:

delay means for changing a drive timing between printing elements in a single block, said delay means delaying the enable signal and the print data signal.

* * * * *